US010662688B2

(12) United States Patent
Bacchetti

(10) Patent No.: US 10,662,688 B2
(45) Date of Patent: May 26, 2020

(54) SYSTEM FOR THE ROTATABLE COUPLING OF A CLOSING ELEMENT AND A STATIONARY SUPPORT STRUCTURE THEREOF

(71) Applicant: IN & TEC S.R.L., Brescia (BS) (IT)

(72) Inventor: Luciano Bacchetti, Nave (IT)

( * ) Notice: Subject to any disclaimer, the term of this patent is extended or adjusted under 35 U.S.C. 154(b) by 0 days.

(21) Appl. No.: 16/300,555

(22) PCT Filed: May 18, 2017

(86) PCT No.: PCT/IB2017/052923

§ 371 (c)(1),
(2) Date: Nov. 10, 2018

(87) PCT Pub. No.: WO2017/199189

PCT Pub. Date: Nov. 23, 2017

(65) Prior Publication Data

US 2019/0284858 A1 Sep. 19, 2019

(30) Foreign Application Priority Data

May 18, 2016 (IT) ..... 102016000051292
May 18, 2016 (IT) ..... 102016000051301

(51) Int. Cl.
*E05D 11/08* (2006.01)
*E05D 5/02* (2006.01)
*E05D 7/081* (2006.01)

(52) U.S. Cl.
CPC ..... *E05D 11/08* (2013.01); *E05D 5/0246* (2013.01); *E05D 7/081* (2013.01); *E05Y 2900/132* (2013.01)

(58) Field of Classification Search
CPC . Y10T 16/54038; E05D 11/08; E05D 11/082; E05D 11/084; E05D 5/0246;
(Continued)

(56) References Cited

U.S. PATENT DOCUMENTS 2,479,075 A * 8/1949 Martin ..... F16B 39/023 411/265
2,591,476 A * 4/1952 Swanson ..... E05F 1/1215 16/54

(Continued)

FOREIGN PATENT DOCUMENTS

DE 102008047708 3/2010

*Primary Examiner* — Chuck Y Mah
(74) *Attorney, Agent, or Firm* — Themis Law

(57) ABSTRACT

A system for the quick mounting of a glass shutter or door to a support frame includes a mounting plate having a first anchoring element to the top of the supporting frame and a second anchoring element to the glass shutter or door. The mounting plate includes a downwardly extending pivot defining an axis and a hinge device having a seat for the pivot. The seat and the pivot are configured to be coupled so as to allow the hinge device to rotate about the axis. A slip-preventing system prevents the separation by gravity of the hinge device from the mounting plate after coupling the pivot to the seat. The second anchoring element is removable so as to allow an operator to mount/dismount the glass shutter or door onto/from the support frame with the hinge device in the working position mounted on the top of the support frame.

13 Claims, 14 Drawing Sheets

(58) Field of Classification Search
CPC . E05D 5/0269; E05D 7/081; E05Y 2900/132; E05Y 2900/146
See application file for complete search history.

(56) References Cited

U.S. PATENT DOCUMENTS

| | | | | | |
|---|---|---|---|---|---|
| 3,474,470 | A * | 10/1969 | Watson | A47K 13/12 | 4/240 |
| 3,837,042 | A * | 9/1974 | White | E05D 11/082 | 16/339 |
| 5,765,263 | A * | 6/1998 | Bolinas | E05D 7/0423 | 16/342 |
| 5,918,347 | A * | 7/1999 | Morawetz | E05D 11/1071 | 16/274 |
| 6,609,273 | B1 * | 8/2003 | Yamada | F16C 11/02 | 16/332 |
| 6,654,985 | B1 * | 12/2003 | Lu | E05D 5/14 | 16/338 |
| 8,099,832 | B1 * | 1/2012 | Shuker | E05D 11/1071 | 16/319 |
| 8,752,247 | B2 * | 6/2014 | Franchini | E05D 11/105 | 16/334 |
| 2011/0072619 | A1 | 3/2011 | Wang | | |
| 2015/0368951 | A1 | 12/2015 | Wang | | |
| 2016/0060937 | A1 | 3/2016 | Bacchetti | | |

* cited by examiner

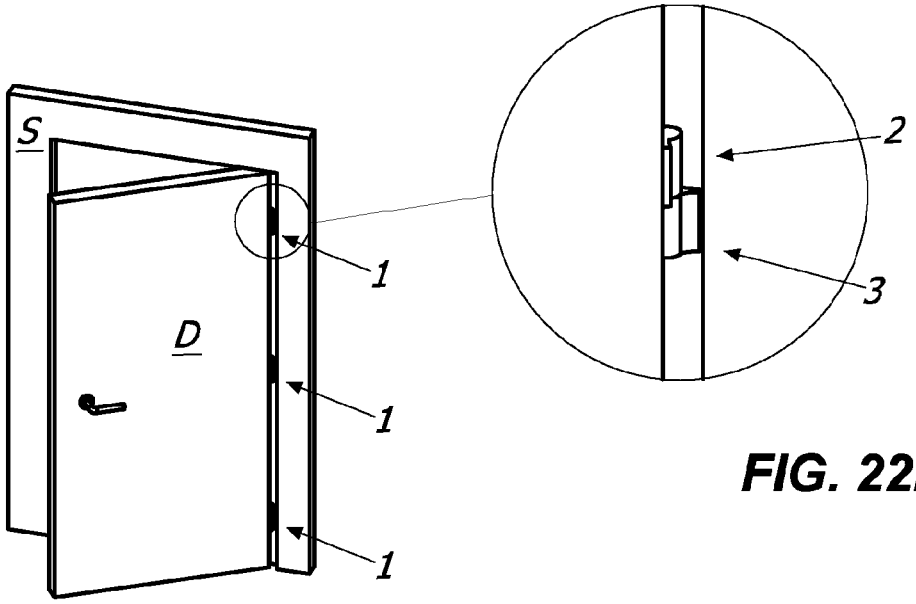
FIG. 22B
FIG. 22A
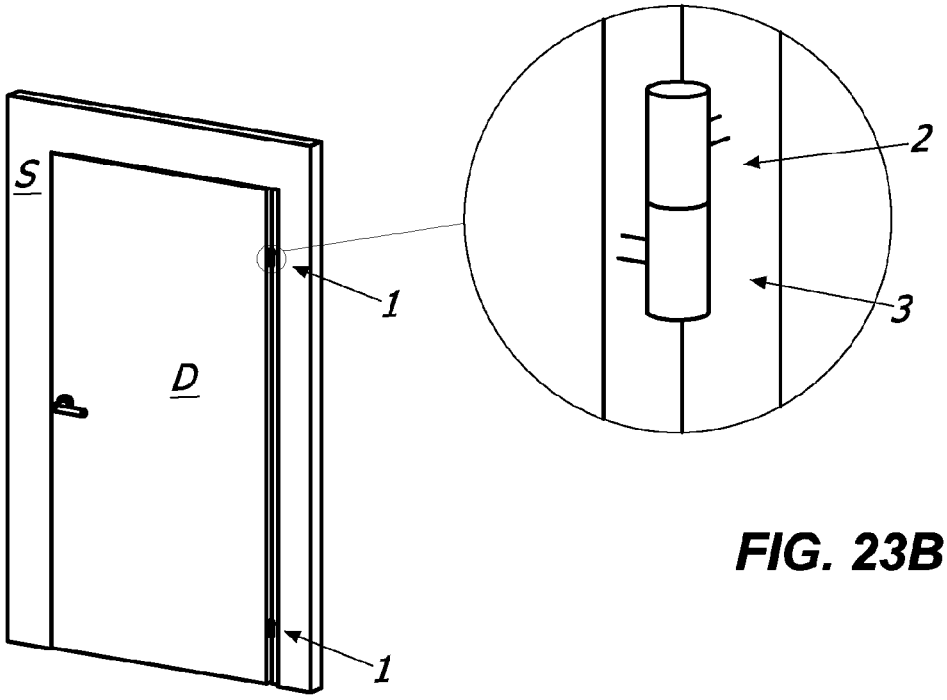
FIG. 23B
FIG. 23A

SYSTEM FOR THE ROTATABLE COUPLING OF A CLOSING ELEMENT AND A STATIONARY SUPPORT STRUCTURE THEREOF

FIELD OF THE INVENTION

The present invention is generally applicable to the technical field of the closing or control hinges, and particularly relates to a system for the rotatable coupling of a glass door or shutter to a support frame thereof.

BACKGROUND OF THE INVENTION

Systems for the rotatable coupling of a closing element such as a door, window, shutter or the like, and a stationary support structure such as a wall, floor, frame or the like are known.

In particular, systems for glass doors or shutter are known, which generally include a plate anchored on the frame and a hinge device, for example a patch fitting anchored to the door.

Such systems are susceptible to be improved, particularly as regards the mounting simplicity, speed and safety thereof.

SUMMARY OF THE INVENTION

The object of the present invention is to at least partially overcome the above-mentioned drawbacks by providing a system having features of high functionality and low cost.

Another object is to provide a easy to mount and quick system for mounting a glass door or shutter and a support frame thereof.

Another object is to provide a particularly secure system for mounting glass door or shutter and a support frame.

Another object is to provide a system for mounting for a glass door or shutter and a supporting frame which allow the control of the door movement.

Such purposes, as well as others which will appear more clearly hereinafter, are fulfilled by a system for mounting a glass door or shutter and a support frame thereof according to what is herein described, claimed and/or shown.

Advantageous embodiments of the invention are defined in accordance with the dependent claims.

BRIEF DESCRIPTION OF THE DRAWINGS

Further features and advantages of the invention will become more evident by reading the detailed description of some preferred but not exclusive embodiments, shown by way of non-limiting example with the help of the annexed drawing, wherein:

FIGS. 22A and 23A are examples of mountings of the embodiment of the system 1 shown in FIGS. 15 to 21, FIGS. 22B and 23B are enlarged views of some details of FIG. 22A and FIG. 23A.

DETAILED DESCRIPTION OF SOME PREFERRED EMBODIMENTS

Figure 1:
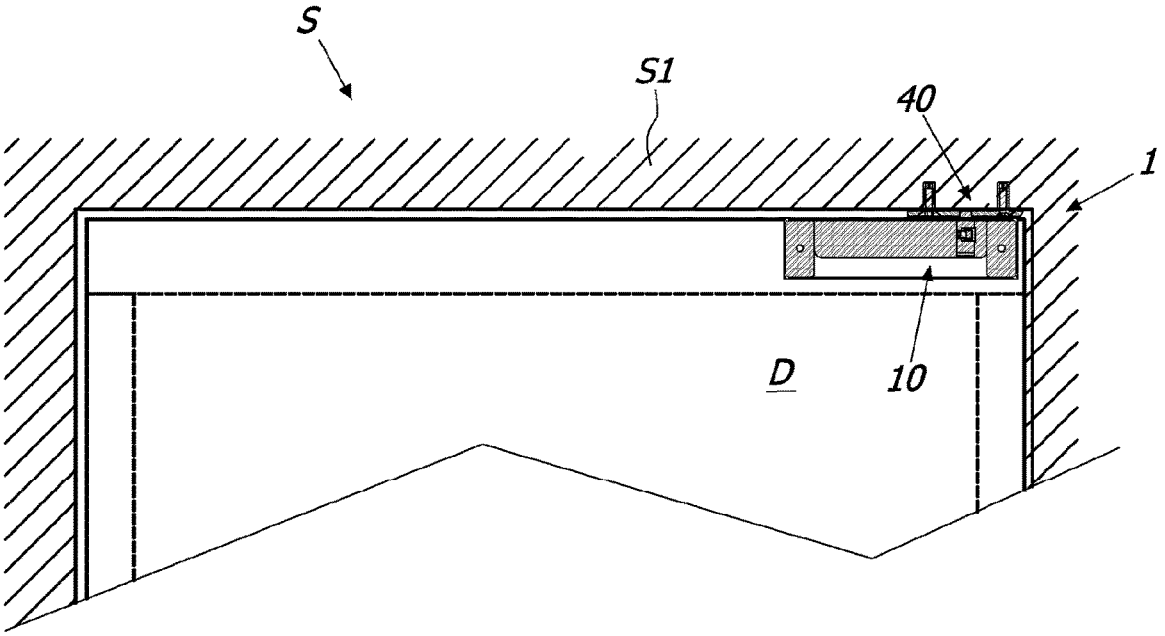
FIGS. 1 and 2 are schematic views of the system 1 in two different mountings.

With reference to the figures, a system 1 for the controlled rotatable coupling of at least one closing element D, such as a door, a shutter, a gate, a window or the like and a stationary support structure S for example such as a wall and/or frame of a door or window and/or a support pillar and/or the floor is described.

As better described below, the system 1 may allow control during opening and/or closing of the same closing element D depending on the configuration thereof.

Thus the system 1 may comprise at least one fixed element 2 defining an axis X that may be anchored to one of the stationary support structure S and the closing element D and at least one elongated mobile element 3 defining an axis Y that may be anchored to the other of the stationary support structure S and the closing element D.

The movable element 3 may thus comprise at least one hinge device 10, which may be of any type. For example, it may be an opening and/or closing hinge of the closing element D, a control hinge, an "anuba" type hinge, as shown in FIGS. 15 to 23B, or a simple handling hinge such as a patch fitting, as shown in FIGS. 1 to 14.

The closing element D may be a glass door or shutter.

According to an aspect of the invention, the hinge device 10 may be anchored to the door D, while the fixed element 2 may be anchored to the supporting structure S, such as the frame, the floor or the ceiling by a mounting plate 40.

Fixed element 2 may comprise at least one pivot 42 which may define the rotation axis X. In particular, the former may be solidably coupled or monolithically with the mounting plate 40.

Figure 2:
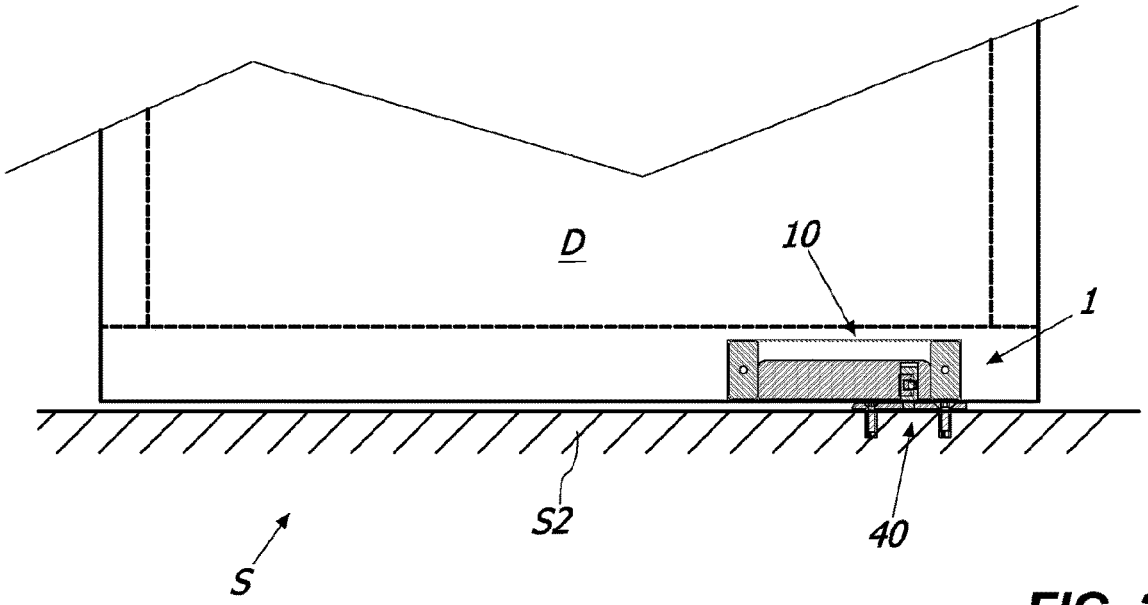

The mounting plate 40 may be mounted on the top S1 of the frame S, as shown in FIG. 1, or at the bottom S2 of the frame S, as shown in FIG. 2, or in case the hinge device 10 is of "anuba" type in any position as shown in FIGS. 22A to 23B.

In particular, in the embodiment illustrated in FIGS. 1 to 14, the mounting plate 40 may have a substantially planar shape, while the pivot 42 may respectively extend from it downwards or upwards defining the axis X.

The hinge device 10 may comprise a hinge body 11. In particular, the latter and the pivot 42 may be reciprocally coupled to each other so as to reciprocally rotate around the axis X between at least one open position corresponding to the opening position of the door D, and at least one closed position, corresponding to the closing position of door D.

The hinge body 11 may comprise a seat 12 for the pivot 42. In particular, the latter may be reciprocally coupled so as to allow the hinge device 10 to rotate around the axis X.

For example, the seat 12 may have a substantially cylindrical shape.

The pivot 42 may include an outer lateral surface 42' which may reciprocally at least partially facing the inner surface 15 of the seat 12 once reciprocally coupled.

According to one aspect of the invention, the system 1 may comprise means 13 for anchoring the hinge device 10 to the door D and means 43 for anchoring the mounting plate 40 to the frame S.

The anchoring means 43 may include male elements, such as pivots or screws, and corresponding female elements, such as seats therefor. In particular, as shown in the annexed figures, the mounting plate 40 may comprise at least one slot 44, preferably a pair of slots 44, susceptible to house the corresponding screws to anchor the mounting plate 40 to the frame S.

The glass door D may define a plane n while the hinge body 11 may be substantially plate-like shaped defining a plane π'. Suitably, the anchoring means 13 may comprise at least one fastening plate-shaped element 17 cooperating with the hinge body 11 for fastening in the opposite sides the glass door D so as the plane π and the plane π' are substantially parallel or coincident.

More specifically, the hinge body 11 may comprise at least one first portion 18 susceptible to interact with a corresponding portion D1 of the glass door D while the fastening element 17 may comprise at least one portion 19 to interact with a corresponding portion D2 of the glass door D opposite to the portion D1.

Suitably, the portion 18 of the hinge body 11 and the portion 19 of the fastening element 17 may be facing each other so that the glass door D is interposed therebetween.

Possibly, as shown in the annexed figures, the hinge body 11 may comprise a pair of portions 18, 18' extending from opposite sides with respect to the hinge body 11 to interact with a corresponding pair of portions D1, D1' of the door D.

On the other hand, the system 1 may comprise a pair of fastening elements 17, 17' with respective portions 19, 19' to interact with a corresponding pair of portions D2, D2' of the glass door D opposed to the portions D1, D1'.

Suitably, the portions 18, 18' of the hinge body 11 and the portions 19, 19' of the respective fixing element 17, 17' may be facing each other so that the door D is interposed therebetween.

In particular, the portions 18, 18' protrude from the hinge body 11 in correspondence of a lateral wall thereof and the fastening elements 17, 17' may be dimensioned so as to be flush with the opposite lateral wall of the hinge body 11, so that the door D is placed in a substantially central position with respect to the hinge body 11.

Figure 3:
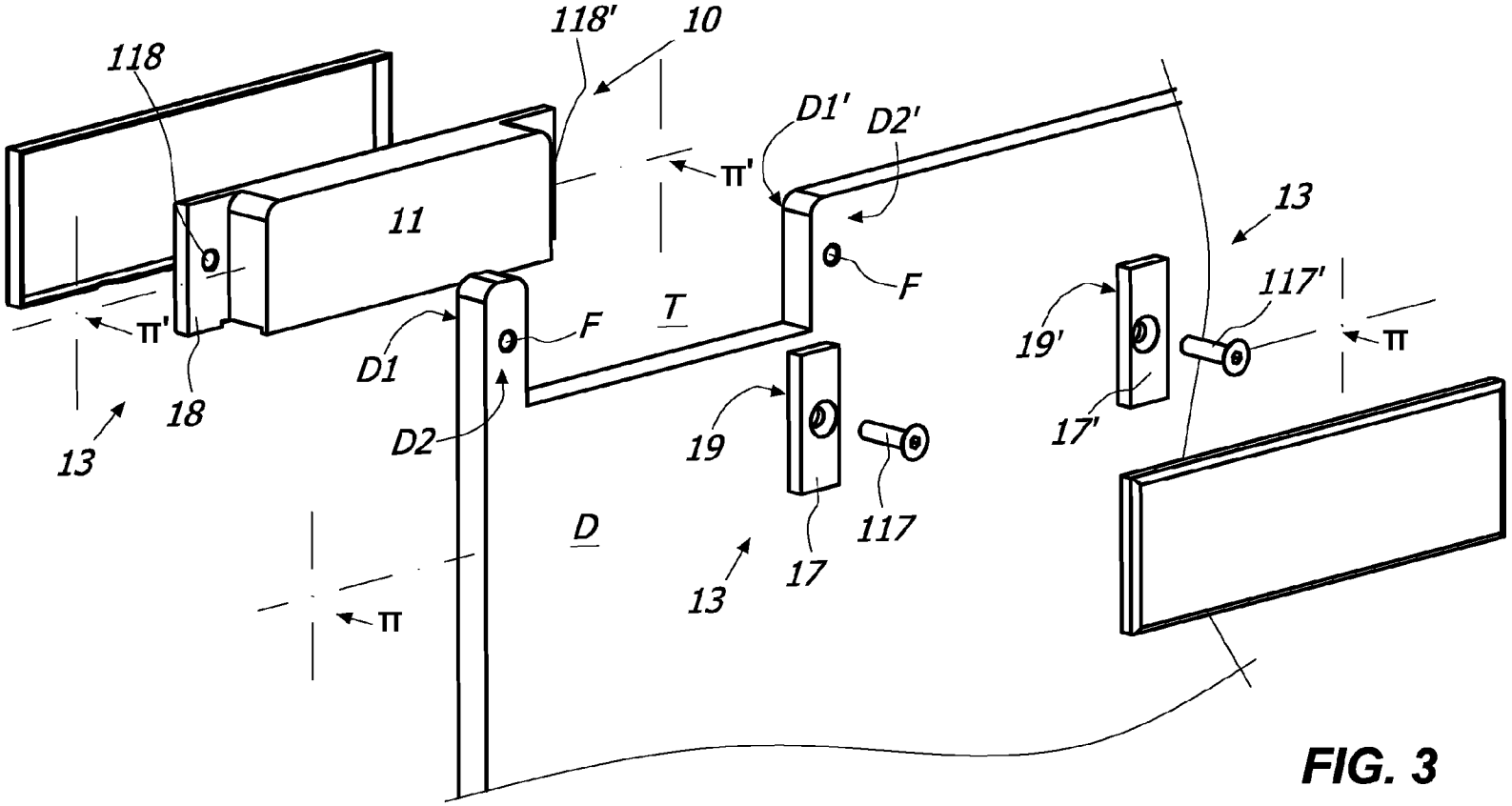
FIG. 3 is an exploded view of some details of system 1.
Figure 4:
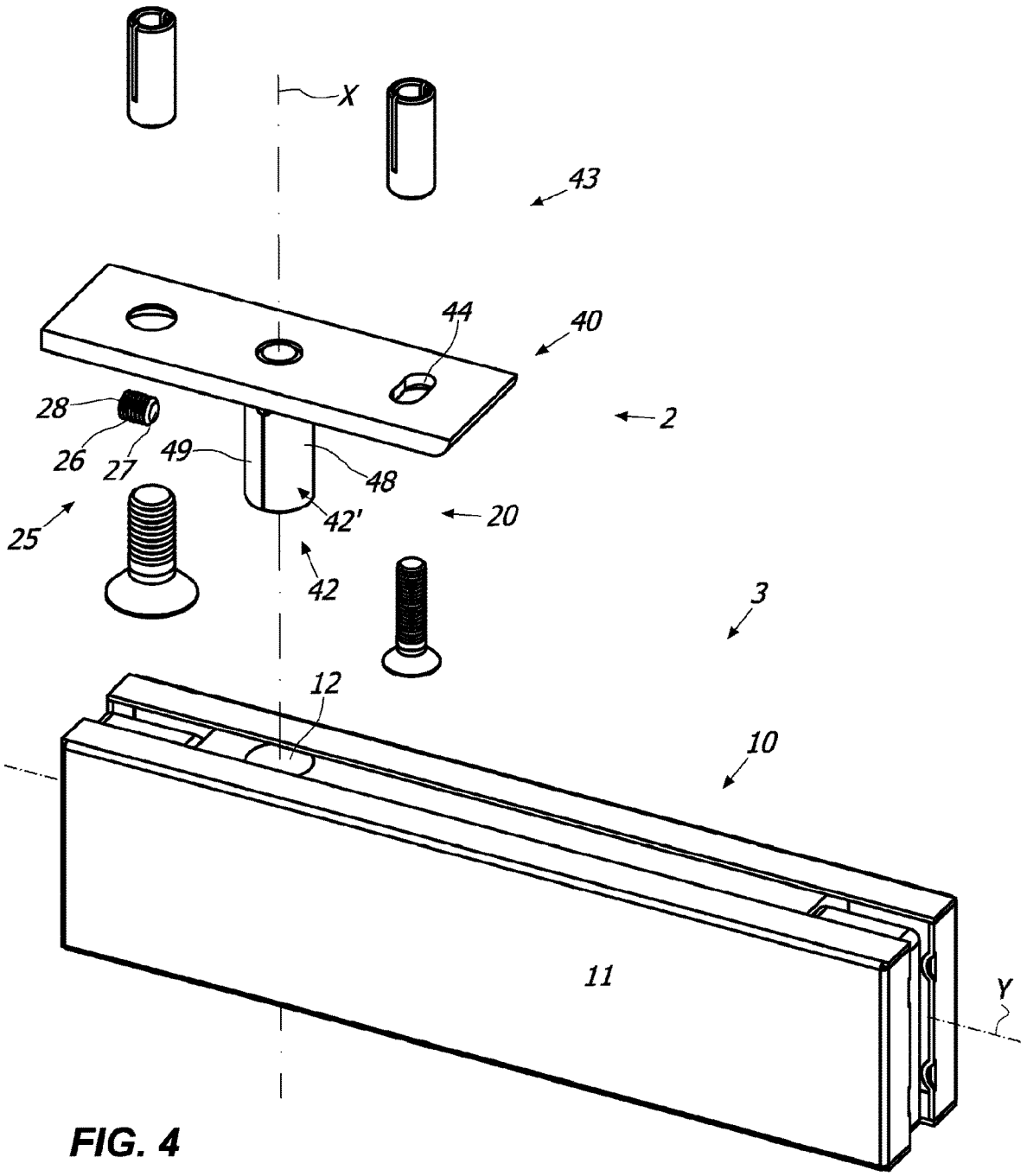
FIG. 4 is an exploded view of some details of a first embodiment of system 1.

More particularly, as shown in FIG. 3, the fastening element 17, 17' may include a male element 117, 117' susceptible to interact with a corresponding female seat 118, 118' of the portion 18, 18' of the hinge body 11.

Suitably, the glass door D may comprise at least one pair of holes F in correspondence of the male element 117, 117' to allow the passage therethrough so as to reciprocally couple the door D and the hinge device 10. Moreover, in correspondence of the latter the glass may comprise a shaped portion T.

The system 1 may also comprise a pair of finishing covers 30, 31 susceptible to come into contact with the glass V of the door D which may be placed at opposite side with respect to the hinge body 11 to hide the latter from the view of an user.

In this way, the system 1 may have a particularly pleasing appearance.

In particular, a first finishing cover 31 may be coupled with the hinge body 11 in correspondence of the portions 18, 18' and the other finishing cover 30 may be coupled with the fastening elements 17, 17'.

Figure 13:
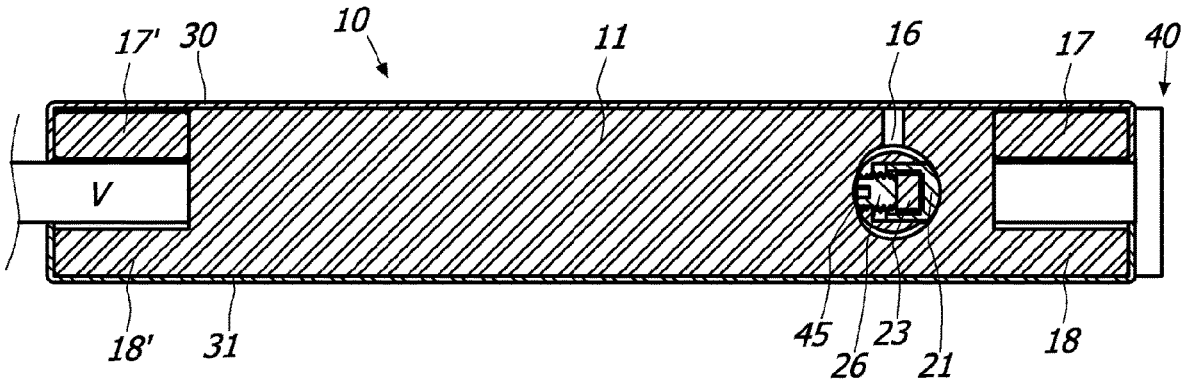
FIGS. 13 and 14 are sectional views of some details of the system 1 in which a glass of different sizes is coupled thereto.
Figure 14:
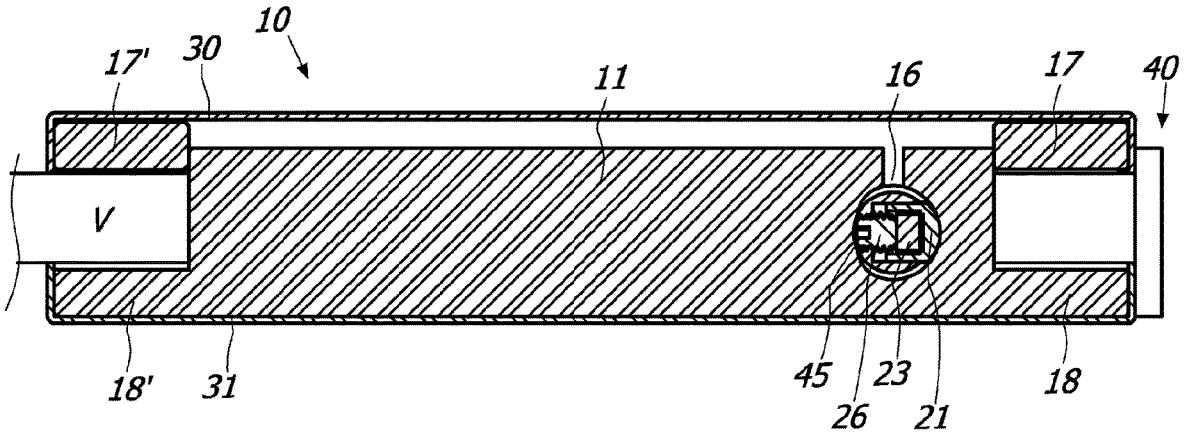
Figure 15:
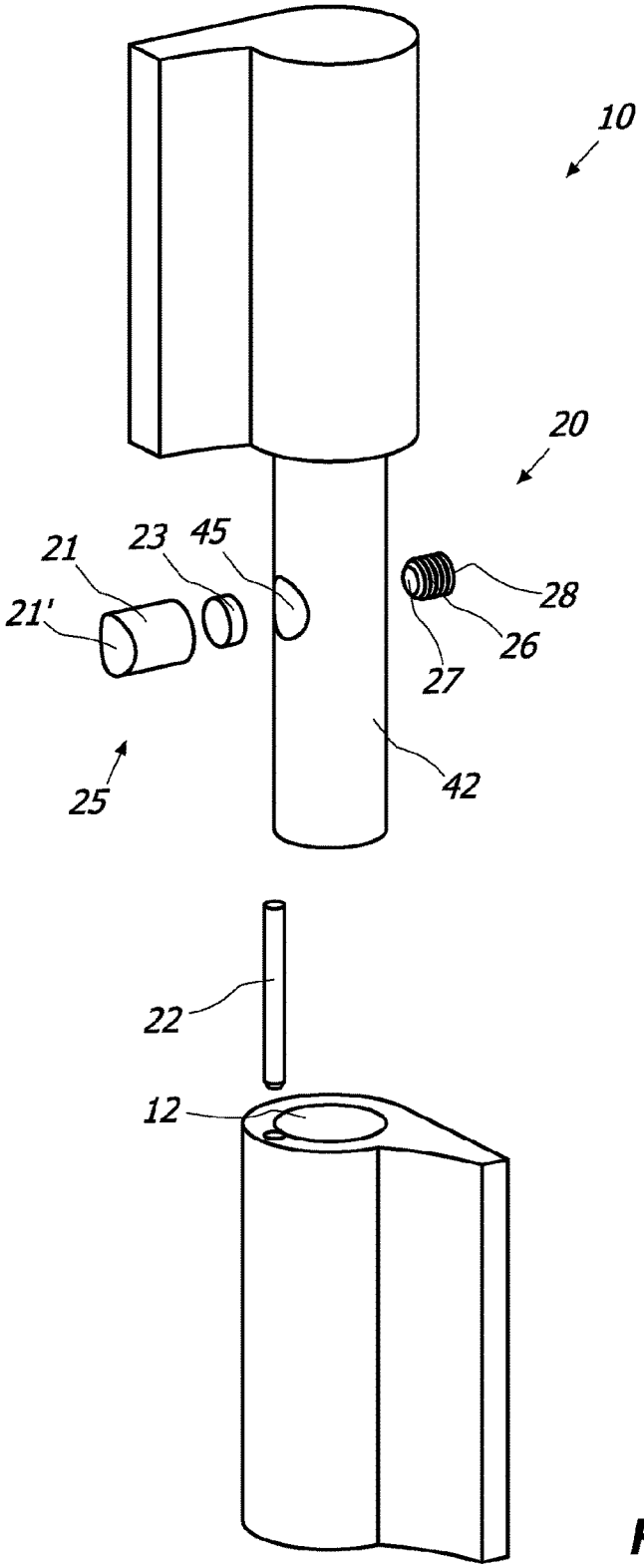
FIG. 15 is an exploded view of some details of a further embodiment of system 1.
Figure 16:
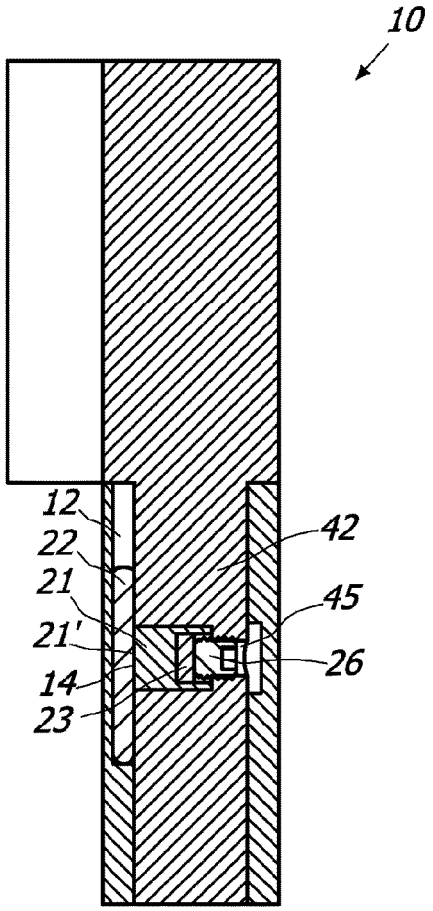
FIG. 16 is a sectional view of some details of the system 1 of FIG. 15.

In this way, advantageously, the finishing cover 30 may move solidly with the latter to house the glass V with different thicknesses. In particular, as shown in FIGS. 13 and 14, depending on the thickness of the glass V, the finishing covers 30, 31 may vary their reciprocal distance so as to always be at least partially in contact with the glass V and hide the hinge body 11 to the view of an user.

According to a particular aspect of the invention, the system 1 may comprise braking means 20 for braking the reciprocal rotation of the hinge device 10 and the mounting plate 40 around the axis X.

In this way, advantageously, the door D may be braked during opening and/or closing depending on the configuration of the hinge device 10.

The braking means 20 may comprise at least one pushing element 21 frictionally acting against at least one portion 14 of the inner surface 15 of the seat 12. In particular, the pushing element 21 may comprise at least one portion 42" of the outer lateral surface 42' of the pivot 42.

More in detail, the pushing element 21 may have an outer surface 21' susceptible to come into contact with the portion 14 of the inner surface 15 of the seat 12 upon the reciprocal rotation thereof.

Figure 5A:
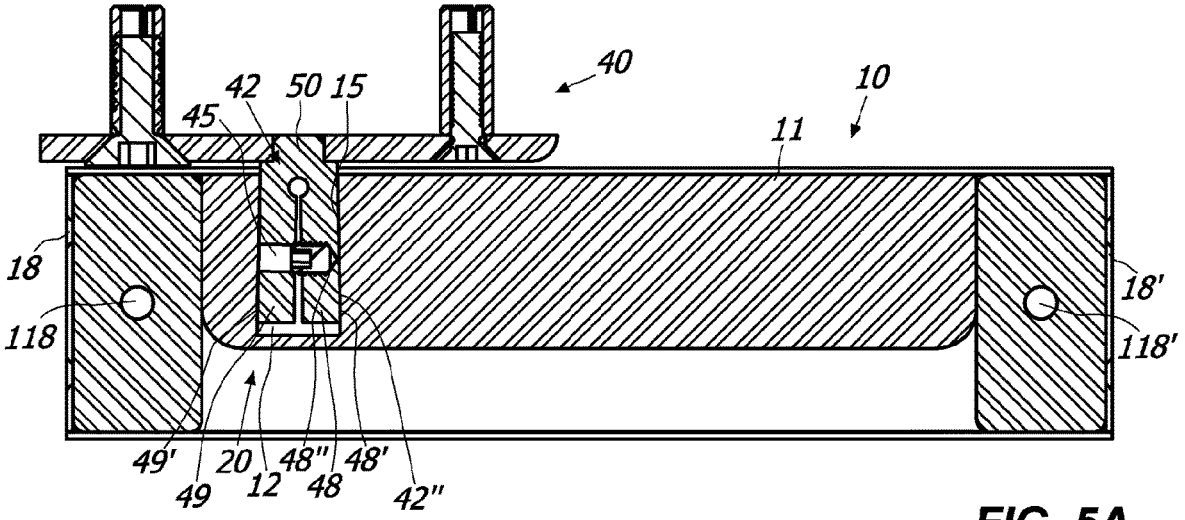
FIGS. 5A and 5B are sectional views of some details of the system 1 of FIG. 4 in different operating phases.
Figure 5B:
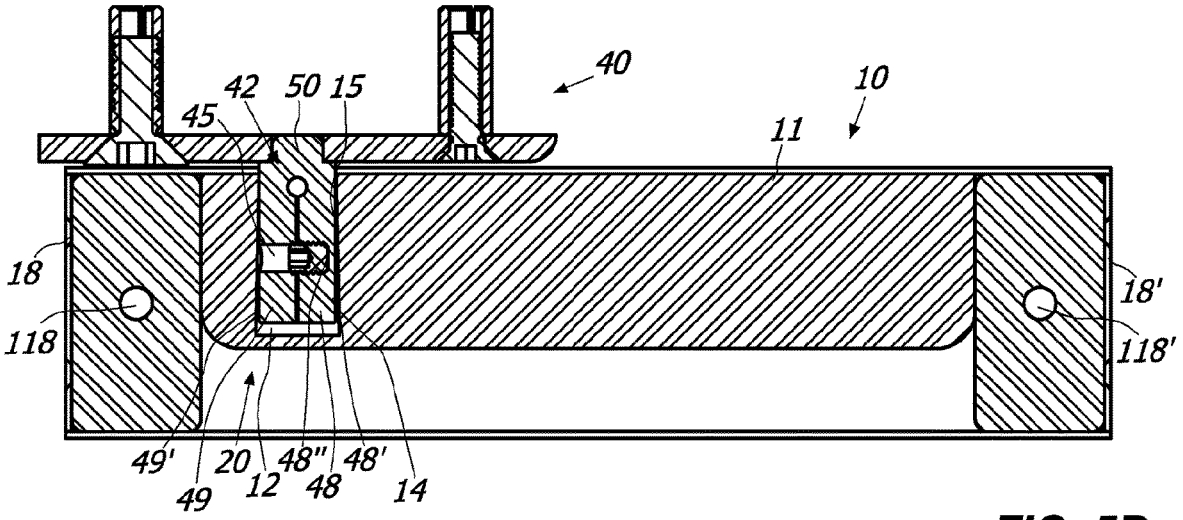

According to a particular embodiment shown in FIGS. 5A and 5B, the pushing element 21 may be integral with the pivot 42. In particular, the portion 42" of the outer lateral surface 42' of the pivot 42 may be in contact with the portion 14 of the inner surface 15 of the seat 12. In other words, the portion 42" of the outer lateral surface 42' of the pivot 42 may define the outer surface 21' of the pushing element 21.

The friction against the portion 14 of the inner surface 15 of the seat 12 may allow to brake the rotation of the door D.

According to another aspect of the invention, the system 1 may comprise means 25 for adjusting the braking action.

Possibly, the seat 12 may be configured so as to determine the points where the pushing element 21 acts with greater or lower friction against it.

For example, as shown in FIGS. 16 to 19, the system 1 may comprise shaped elements, such as pad 22, placed inside the seat 12 so that during rotation of the hinge device 10 the latter will come into contact with the pushing element 21 so as to Increase its braking action.

Figure 19:
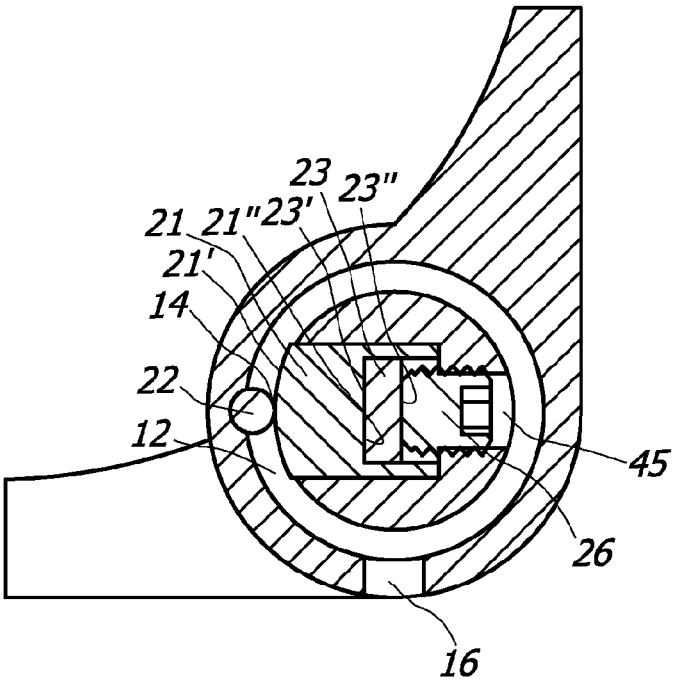
FIG. 19 is an enlarged view of some details of the system 1 of FIG. 15.

In this case, the outer surface portion 21' of the pushing element 21 in contact with the pad 22 may define the contact portion 14 of the inner surface 15 of the seat 12, as shown in FIG. 19.

Figure 10:
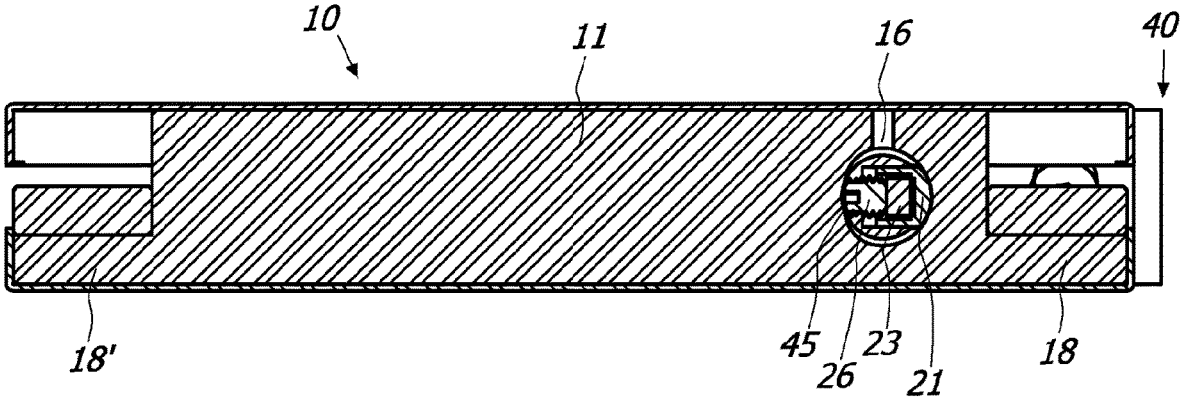
FIGS. 10, 11 and 12 are sectional views of the system 1 of FIG. 9 in different operating phases.
Figure 11:
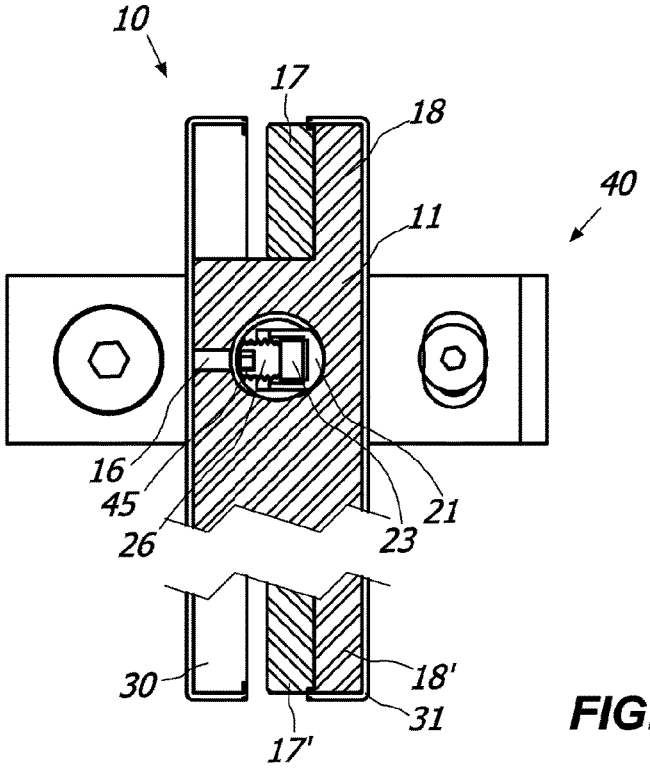
Figure 12:
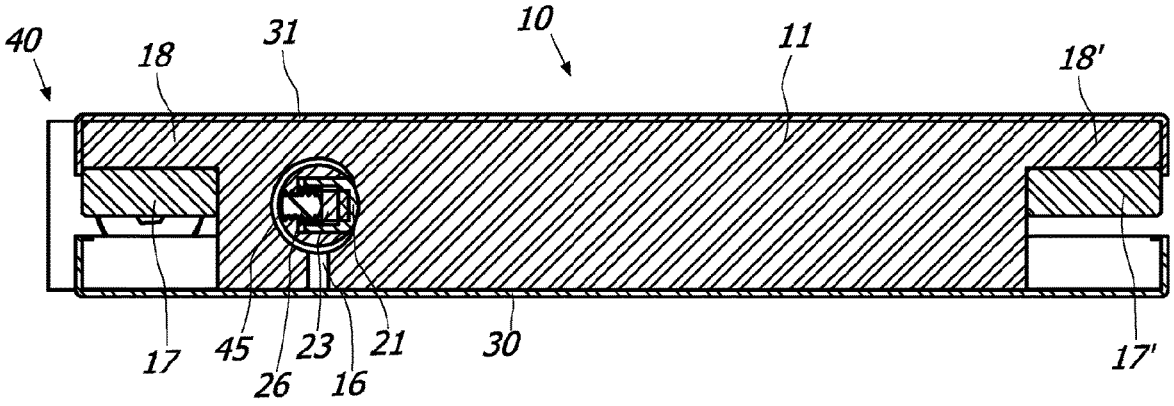

Possibly, as shown in FIGS. 10, 11, and 12, the inner surface 15 of the seat 12 may be suitably shaped to define the points with greater/lower braking action, for example it may have a substantially oval section.

According to a preferred but not exclusive embodiment, the adjustment means 25 may act directly or indirectly on the pushing element 21 to force it against the inner surface 15 of the seat 12 so as to vary the friction and therefore the braking action.

As shown in FIGS. 4 to 19, the adjusting means 25 may comprise at least one adjusting screw 26 through the hinge body 11 which may have a working end 27 susceptible to act on the pushing element 21 and an opposite operateable end 28 susceptible to be operated by an operator.

The hinge body 11 may comprise a passing through hole 16 for the adjusting screw 26. Suitably, such passing-through hole 16 may be configured so as to be accessible by the operator so that the latter may operate on the operateable end 28 of the same adjusting screw 26.

Figure 20:
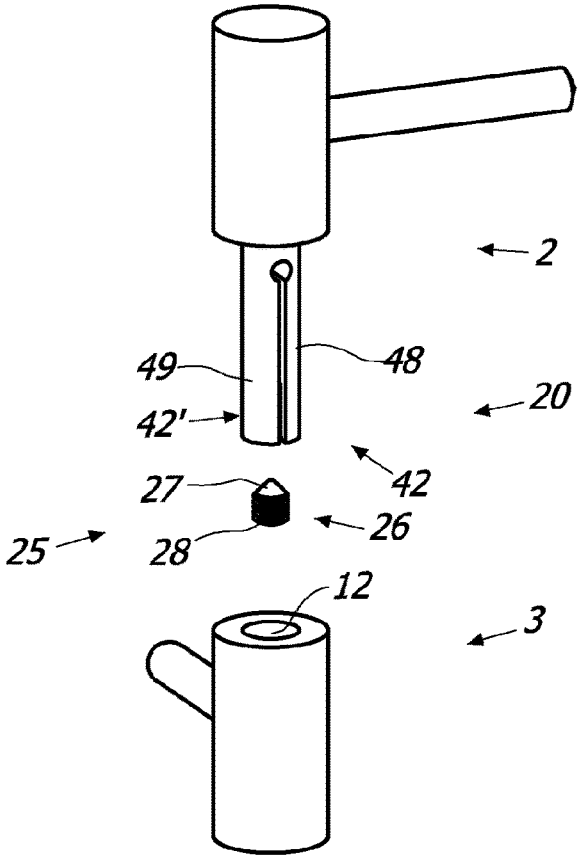
FIG. 20 is an exploded view of some details of a further embodiment of system 1.
Figure 21:
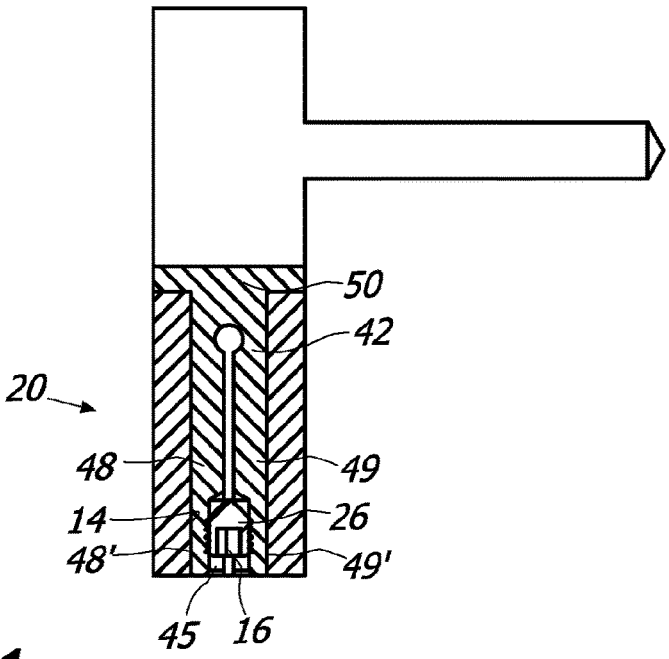
FIG. 21 is a partially sectional view of some details of the system 1 of FIG. 20.

For example, the passing-through hole 16 may be substantially transverse to the axis X as shown in the embodiments shown in FIGS. 4 to 19, or may be substantially coaxial to the same axis X as shown in the embodiment of the FIGS. 20 and 21.

More particularly, as shown in FIGS. 10, 11 and 12 and FIGS. 17 and 18, the passing-through hole 16 may be rotatable around the axis X solidally with the hinge body 11 between at least one first working position in which the adjusting screw 26 and the passing-through hole 16 are reciprocally spaced apart (FIGS. 10, 12 and 18) and at least one second working position (FIGS. 11 and 17) in which the adjusting screw 26 and the passing-through hole 16 are reciprocally aligned so as to allow the operator to selectively access the operateable end 28 of the adjusting screw 26.

For example, the second working position may correspond to the open position of the door D, and preferably, to an open position of about 90°.

Figure 17:
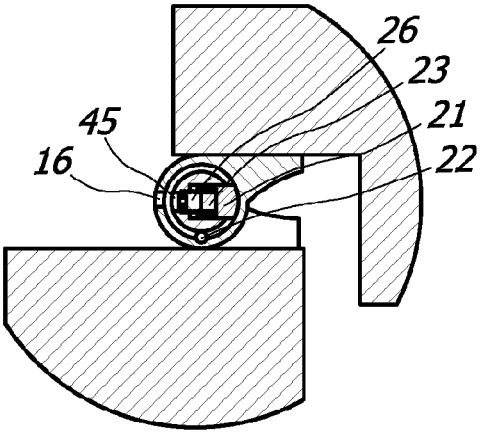
FIGS. 17 and 18 are enlarged section views of some details of the system 1 of FIG. 15 in two different operating phases.
Figure 18:
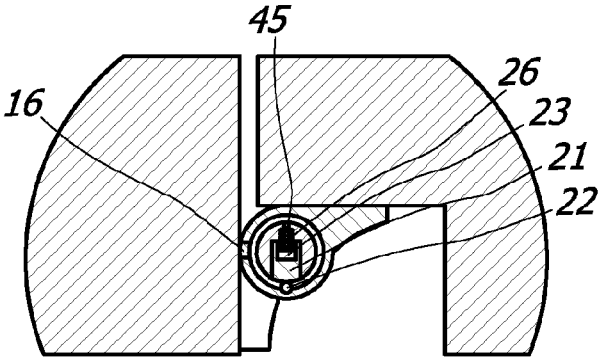

Thanks to this feature, the operator may access such operateable end 28 when the hinge device 10 and the mounting plate 40 are reciprocally coupled. Advantageously, the operator may access the adjusting screw 26 to adjust the braking action even when the hinge device 10 and the door D are coupled, by rotating the same door D as shown in FIGS. 11 and 17, i.e. without the needing to dismount the hinge device 10 therefrom.

As shown in the annexed figures, the pivot 42 may include a passing-through seat 45 susceptible to house the adjustment screw 26. Preferably, the passing-through seat 45 may be at least partially threaded with respect the adjusting screw 26.

Such seat 45, similarly to the passing-through hole 16, may have a substantially transversal development to the axis X or may have a substantially coaxial development to the same axis X.

Suitably, the seat 45 and the passing-through hole 16 may be substantially coaxial upon the selective access by the operator to the working end 27 of the adjusting screw 26, for example when the hinge device 10 is in the working position shown in FIG. 11.

According to an aspect of the invention, as shown in FIGS. 4, 5A, 5B and 20, 21, the pivot 42 may comprise at least one movable portion 48 which may have at least one respective outer lateral surface 48' susceptible to come into contact with the portion 14 of the inner surface 15 of the seat 12. In other words, at least one part of said outer lateral surface 48' may define the outer contact surface 21' of the pushing element 21.

The operating end 27 of the adjusting screw 26 may act on the inner surface 48" of the portion 48 so as to force the outer surface 48' thereof against the portion 14 of the inner surface 15 of the seat 12.

Possibly the pivot 42 may comprise a second portion 49 facing the portion 48 and reciprocally coupled to one end 50 thereof. In particular, the portion 49 may further include a respective outer lateral surface 49' susceptible to come into contact with the portion 14 of the inner surface 15 of the seat 12 to define the outer contact surface 21' of the pushing element 21.

Suitably, therefore, the seat 45 may be configured so as to interact with both portions 48, 49 of the pivot 42 so that the adjusting screw 26 may be coupled with both such portions 48, 49.

In particular, the adjusting screw 26 may promote the separation of the portions 48, 49 and the consequent greater friction between the outer surfaces 48', 49' thereof and the portion 14 of the inner surface 15 of the seat 12 (FIGS. 5A and 21), while the unscrewing of the same adjusting screw 26 may promote the approach of the portions 48, 49 and the consequent lower friction between the outer surfaces 48', 49' of the same portions 48, 49 and the portion 14 of the inner surface 15 of the seat 12 (FIG. 5B).

According to a different embodiment, the pushing element 21 may be a shaped element, for example a shoe susceptible to couple with the pivot 42 to slide inside the seat 45.

In particular, the pushing element 21 may have an inner surface 21" susceptible to interact with the working end 27 of the adjusting screw 26.

In this way, the screwing/unscrewing of the adjusting screw 26 may correspond to the radial displacement of the pushing element 21 so as to adjust the friction between the latter and the seat 12, and hence the braking action of the system 1.

Figure 6:
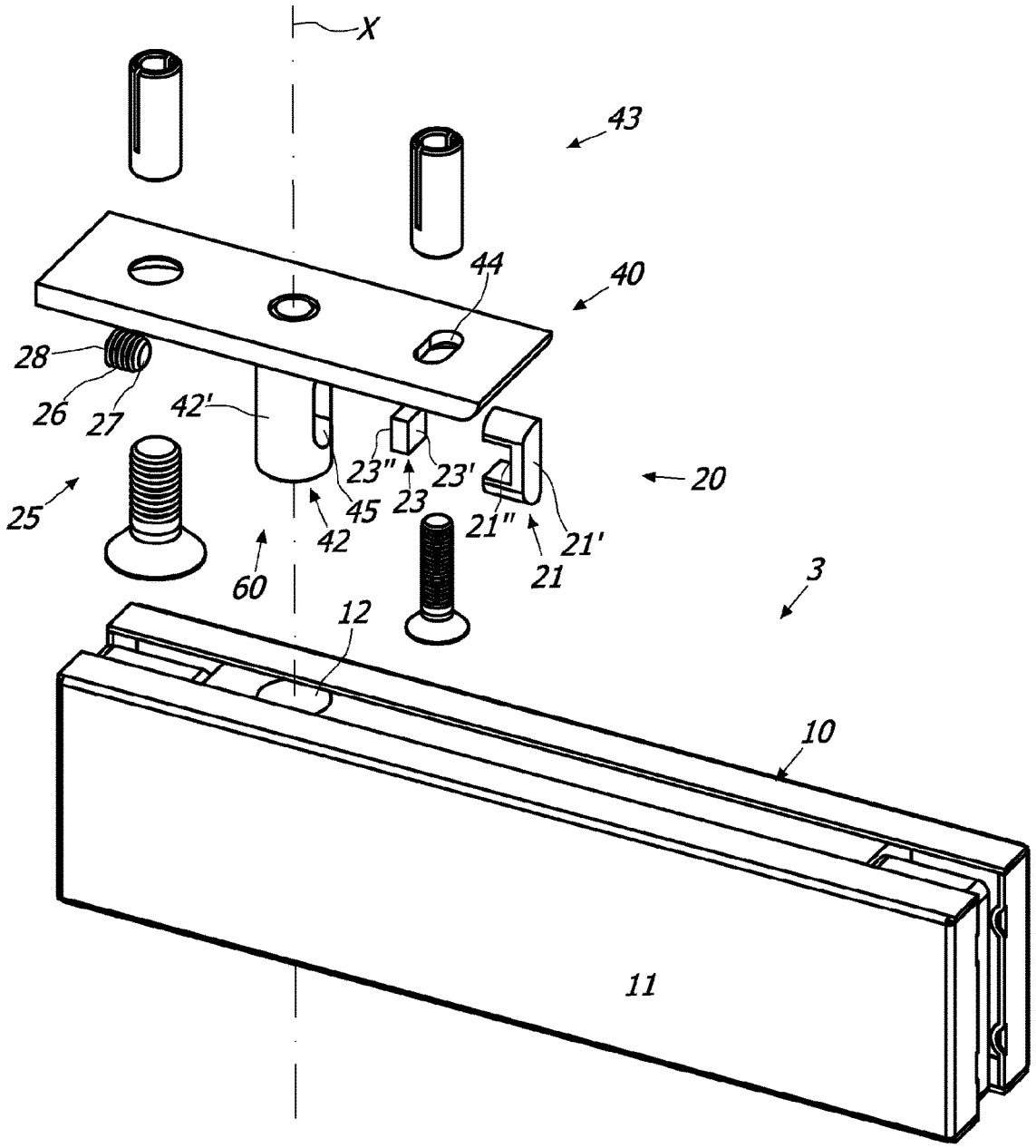
FIG. 6 is an exploded view of some details of a second embodiment of the system 1.
Figure 7:
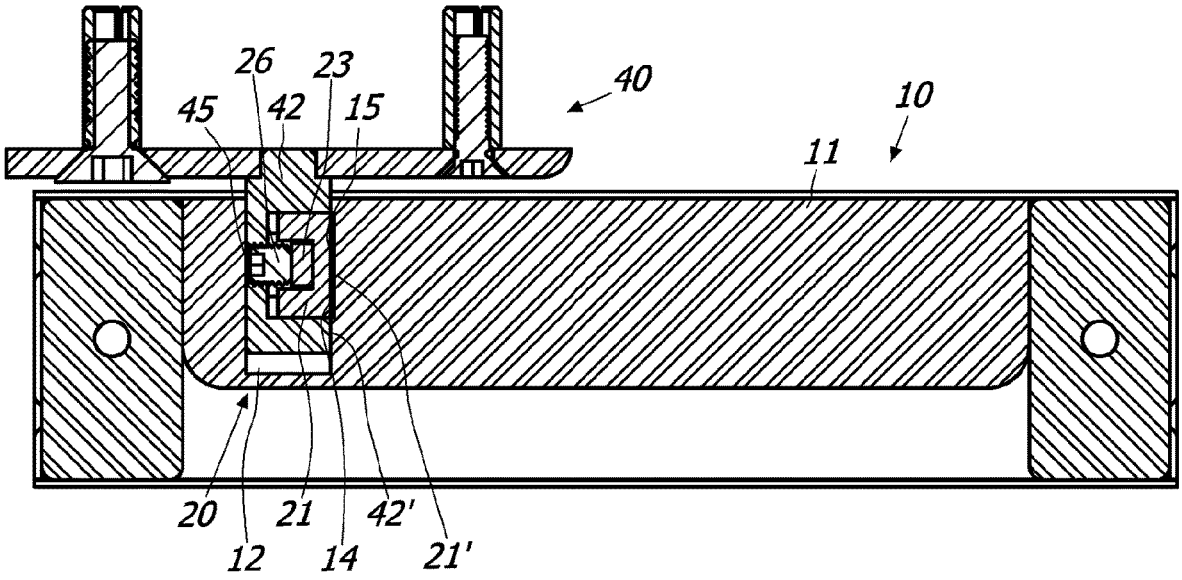
FIG. 7 is a sectional view of some details of the system 1 of FIG. 6.
Figure 8:
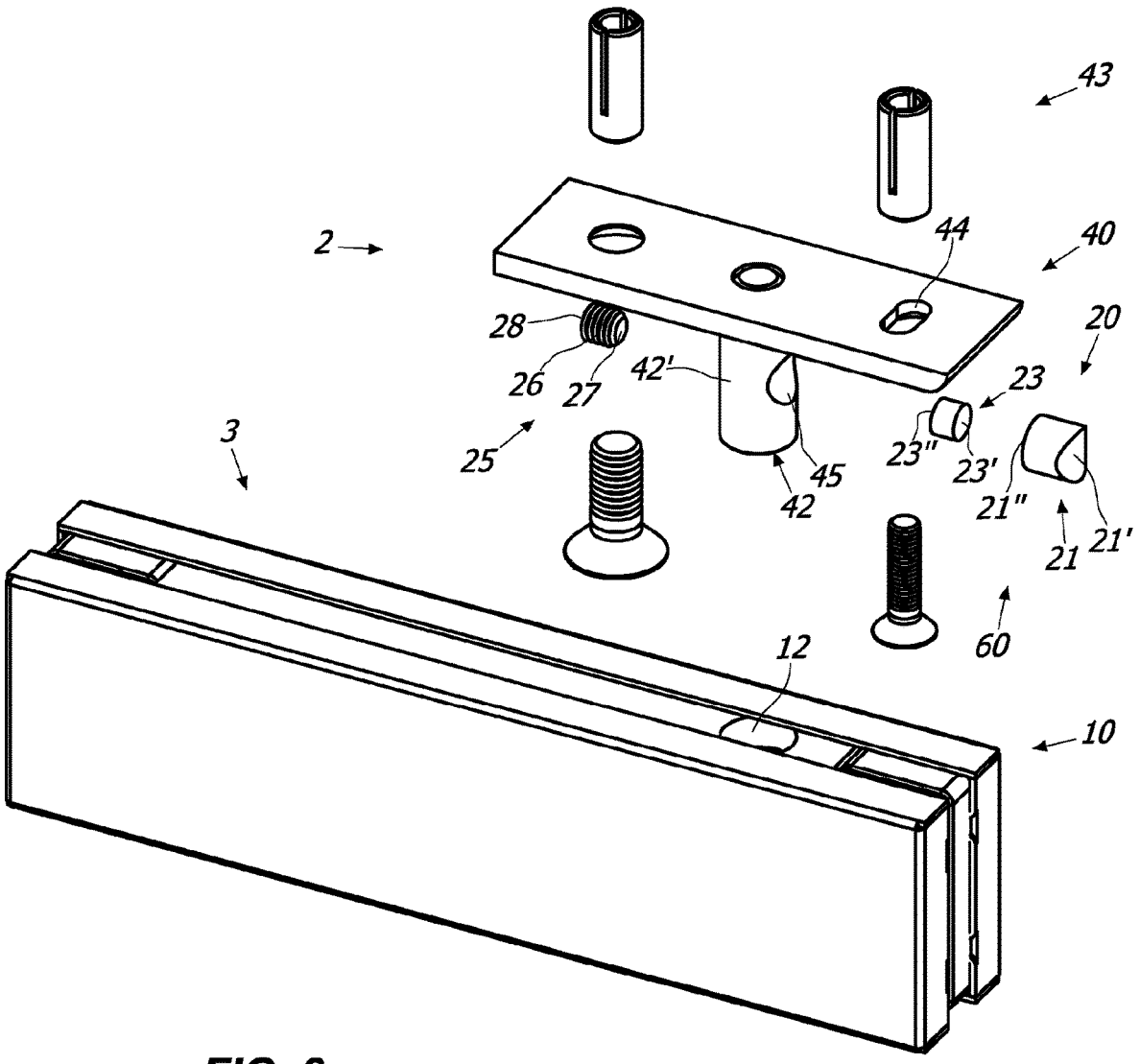
FIG. 8 is an exploded view of some details of a further embodiment of system 1.
Figure 9:
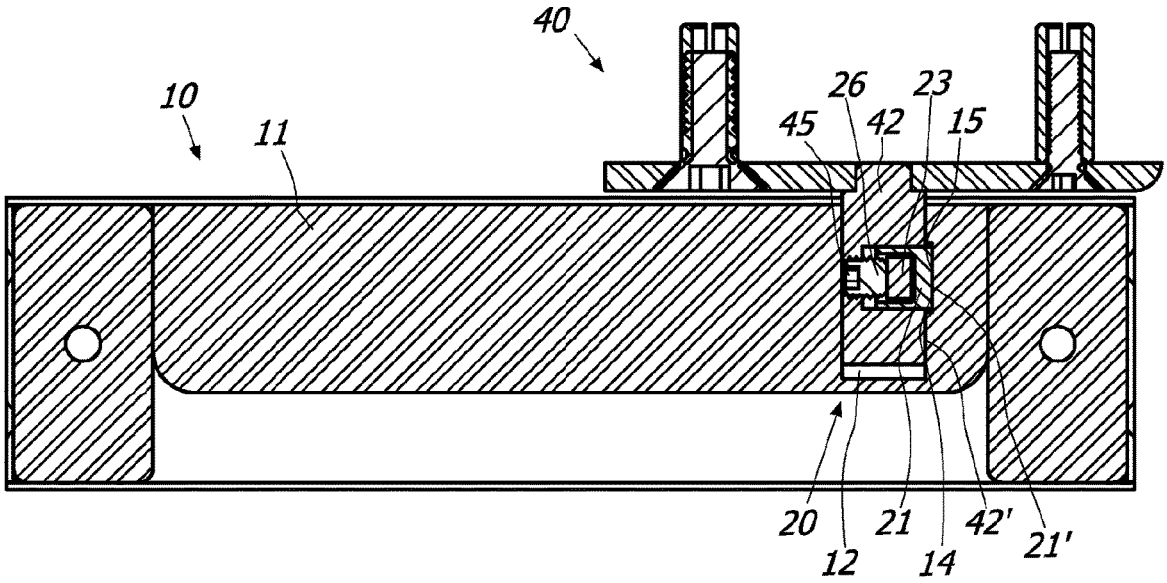
FIG. 9 is a sectional view of some details of the system 1 of FIG. 8.

Suitably, the pushing element 21 may be configured so that the contact portion 14 of the inner surface 15 of the seat 12 is particularly large. For example, the pushing element 21 may have an elongated "C" shape as shown in FIG. 6.

Thanks to such feature, the dimensions of the cylindrical seat 21 may be minimal.

According to another embodiment of the invention, the pushing element 21 may be at least partially made of a polymeric material.

For example, this material may be a relatively hard compact polyurethane. For example, the Shore A hardness of such material may be 70 Sh A to 90 Sh A.

According to a further preferred but not exclusive embodiment of the invention, the pushing element 21 may comprise a body 23 made of such polymeric material.

The polymeric body 23 may be interposed within the passing-through seat 45 between the working end 27 of the adjusting screw 26 and the pushing element 21 to force the latter against the inner surface 15 of the seat 12.

In particular, the polymeric body 23 may be substantially unitary with the pushing element 21, or, as shown in FIGS. 6 to 9, may consist of a parallelepiped made of such polymeric material having an outer 23' and inner 23" surfaces susceptible to be in contact respectively with the inner surface 21" of the pushing element 21 and the working end 27 of the adjusting screw 26.

According to another aspect of the invention, the reciprocal coupling of the hinge device 10 and the mounting plate 40, i.e. of the seat 12 and pivot 42, may be of a removable type. In particular, in order to form such coupling, the seat 12 and the pivot 42 may be coupled by slide along the axis X.

Suitably, the system 1 may include slip-preventing means 60 to prevent the reciprocal separation of the seat 12 and pivot 42 once coupled.

Thanks to this feature, the slip-preventing means 60 may prevent the separation by gravity of the hinge device 10 and the mounting plate 40 once the latter are coupled on the top S1 of the frame S.

According to a particular aspect of the invention, the same braking means 20 above mentioned may prevent the reciprocal separation of the hinge device 10 and the pivot 42.

In particular, the friction between the outer surface 21' of the pushing element 21 and the contact portion 14 of the inner surface 15 of the seat 12 may block the reciprocal sliding of the pivot 42 and the seat 12 along the axis X.

In other words, the braking means 20 may define the slip-preventing means 60.

Moreover, the anchoring means 13 may be of a removable type so as to allow the operator to mount/dismount the glass door D on the support frame S with the hinge device 10 in the operative position mounted on the top S1 of the same frame S.

Therefore, in use at first the operator may attach the mounting plate 40 to the support frame S in the preferred positions, for example on the bottom and on the top by the anchoring means 43, and subsequently the operator may couple the hinge device 10 and the mounting plate 40, i.e. the seat 12 of the former and the pivot 42 of the latter.

Possibly, for example when the hinge device 10 is coupled on the top S1 of the frame S, the operator may act on the adjusting means 25, for example the adjusting screwing 26 to prevent the separation of the hinge device 10 and the mounting plate 40 by the gravity.

The operator may anchor the door D and the hinge device 10 by the anchoring means 13. Thanks to the slip-preventing means 60, thus the operator may move only the glass door D, may approach thereto the hinge device 10 in correspondence of the portions D1, D1' and may anchor the door D to the hinge by the fixing elements 17.

In this way, the assembly operation may be simple and fast.

On the other hand, the anchorage operation of the door D may be performed in a time interval after the coupling of the hinge 10 and the mounting plate 40.

In any case, thanks to the above described features, the installation of the glass door D and the frame S may be extremely simple and may be safely carried out.

Subsequently, once the door D is positioned as above described and shown in FIG. 11, the operator may access the operateable end 28 of the adjusting screw 26 to screw and/or unscrew the latter so as to adjust the braking action of braking means 20.

Basically, the friction of the pushing element 21 against the seat 12 may act as slip-preventing means during the assembly of the door D by opposing to the gravity force and may act as braking means during the movement of the same door D.

From the above description, it appears evident that the invention fulfils the intended objects.

The invention is susceptible of numerous modifications and variations, all falling within the annexed claims. All the details may be replaced with other technically equivalent elements, and the materials may be different according to requirements, without departing from the scope of the invention defined by the annexed claims.

The invention claimed is:

1. A system for rotatable coupling of a glass shutter or door to a supporting frame, comprising:

a mounting plate anchorable to one of the supporting frame or the glass shutter or door, the mounting plate including a pivot defining an axis;

a hinge device anchorable to the other one of the supporting frame or the glass shutter or door, the hinge device comprising a hinge body, which includes a seat configured to rotatably house the pivot, the seat including an inner surface adapted to remain at least partially faced to the pivot;

a braking system that brakes a reciprocal rotation of the hinge device and the mounting plate around the axis, the braking system including at least one pushing element housed in the pivot and frictionally acting on at least one first portion of the inner surface of the seat; and a friction adjusting system housed in the pivot and acting, directly or indirectly, on the at least one pushing element to increase or decrease pressure of the at least one pushing element against the at least one first portion of the inner surface of the seat, wherein the friction adjusting system includes at least one adjusting screw passing through the hinge body and having a working end adapted to act on the pushing element and an opposite operable end, the hinge body having a pass-through hole to allow an operator to access to the operable end, and wherein the pass-through hole is a transverse hole rotating integrally with the hinge body around the axis between at least one first working position, in which the adjusting screw and the pass-through hole are reciprocally spaced apart, and at least one second working position, in which the adjusting screw and the pass-through hole are aligned so as to allow an operator to selectively access the operable end with the hinge device mounted in an operating position.

2. The system according to claim 1, wherein the pivot includes a pass-through seat adapted to house the at least one adjusting screw, the pass-through seat and the pass-through hole being essentially coaxial upon access by the operator to the operable end of the at least one adjusting screw.

3. The system according to claim 1, wherein the pivot and the seat are adapted to be reciprocally coupled and uncoupled by sliding along the axis.

4. The system according to claim 1, wherein the pivot includes a lateral outer surface, at least one second portion of the lateral outer surface defining the at least one pushing element.

5. The system according to claim 1, wherein the pivot is made of two portions facing each other and reciprocally coupled at one end, each of the two portions including a respective second portion of an outer lateral surface of the pivot, the adjusting screw being coupled to both portions of the pivot so that a screwing/unscrewing of the adjusting screw promotes a removal/approach of the two portions of the pivot, whereby more/less friction between the second portions of the outer lateral surface of the pivot and the inner surface of the seat.

6. A system for rotatable coupling of a glass shutter or door to a supporting frame, comprising:

a mounting plate anchorable to one of the supporting frame or the glass shutter or door, the mounting plate including a pivot defining an axis;

a hinge device anchorable to the other one of the supporting frame or the glass shutter or door, the hinge device comprising a hinge body, which includes a seat configured to rotatably house the pivot, the seat including an inner surface adapted to remain at least partially faced to the pivot;

a braking system that brakes a reciprocal rotation of the hinge device and the mounting plate around the axis, the braking system including at least one pushing element housed in the pivot and frictionally acting on at least one first portion of the inner surface of the seat; and a friction adjusting system housed in the pivot and acting, directly or indirectly, on the at least one pushing element to increase or decrease pressure of the at least one pushing element against the at least one first portion of the inner surface of the seat, wherein the at least one pushing element includes a polymeric body.

7. The system according to claim 6, wherein the at least one pushing element further includes a pad in contact with the inner surface of the seat, the polymeric body acting on the pad to force the pad against the seat.

8. The system according to claim 7, wherein the inner surface of the seat is shaped so as to define points where the at least one pushing element acts with greater or smaller friction thereon.

9. The system according to claim 8, wherein the mounting plate comprises first member that anchors the mounting plate to a top of the supporting frame (S), the pivot extending downwardly.

10. The system according to claim 9, wherein the hinge device further comprises a second member that anchors the hinge device to the glass shutter or door, the seat and the pivot being adapted to be coupled so as to allow the hinge device to rotate around the axis.

11. The system according to claim 10, wherein the breaking system provides a slip-preventing system adapted to prevent separation by gravity of the hinge device from the mounting plate after the pivot and the seat are reciprocally coupled.

12. The system according to claim 11, wherein the second anchoring member is removable to allow an operator to mount/dismount the glass shutter or door onto/from the support frame with the hinge device in a working position mounted on the top of the support frame.

13. The system according to claim 12, wherein the pivot and the seat are adapted to be reciprocally coupled and uncoupled by sliding along the axis, the slip-preventing system including at least one pushing element frictionally acting on at least one first portion of the inner surface of the seat to avoid a reciprocal slipping of the inner surface if the seat along the axis.

* * * * *